US008669914B2

(12) United States Patent
Pan et al.

(10) Patent No.: US 8,669,914 B2
(45) Date of Patent: Mar. 11, 2014

(54) DUAL-BAND ANTENNA AND RELATED WIRELESS COMMUNICATION APPARATUS

(75) Inventors: Bo Pan, Irvine, CA (US); Ching-Wei Ling, Tainan County (TW)

(73) Assignee: Realtek Semiconductor Corp., Hsinchu (TW)

( * ) Notice: Subject to any disclaimer, the term of this patent is extended or adjusted under 35 U.S.C. 154(b) by 386 days.

(21) Appl. No.: 13/096,436

(22) Filed: Apr. 28, 2011

(65) Prior Publication Data

US 2012/0274534 A1 Nov. 1, 2012

(51) Int. Cl.
*H01Q 11/00* (2006.01)

(52) U.S. Cl.
USPC ..... 343/843; 343/770

(58) Field of Classification Search
USPC ..... 343/843, 770, 796
See application file for complete search history.

(56) References Cited

U.S. PATENT DOCUMENTS

| | | | | |
|---|---|---|---|---|
| 7,573,424 | B2 * | 8/2009 | Mei | 343/700 MS |
| 8,310,398 | B2 * | 11/2012 | Deng et al. | 343/700 MS |
| 2012/0176291 | A1 * | 7/2012 | Hsueh | 343/843 |
| 2013/0057431 | A1 * | 3/2013 | Lenormand et al. | 342/361 |

* cited by examiner

*Primary Examiner* — Ahshik Kim
(74) *Attorney, Agent, or Firm* — Birch, Stewart, Kolasch & Birch, LLP

(57) ABSTRACT

A dual-band antenna is disclosed including: a first antenna comprising: a first radiating portion including a plurality of separated radiating strips positioned on a first plane of a circuit board; a second radiating portion including a plurality of separated radiating strips positioned on a second plane of the circuit board; and a plurality of vias for coupling the plurality of radiating strips on the first plane with the plurality of radiating strips on the second plane to form a spiral radiating body; a second antenna having a radiating plane coupled with the first radiating portion or the second radiating portion; a shorting element coupled with the radiating plane and shared by the first and second antennas; and a feeding element coupled with the radiating plane and shared by the first and second antennas; wherein the width of part of the radiating plane gradually increases along a direction.

24 Claims, 6 Drawing Sheets

DUAL-BAND ANTENNA AND RELATED WIRELESS COMMUNICATION APPARATUS

BACKGROUND

The present disclosure generally relates to a dual-band antenna, and more particularly, to a compact dual-band antenna with wide bandwidth and related wireless communication apparatuses.

Antenna is an important component for a wireless communication apparatus, but it often occupies considerable area and volume of the circuitry module. With the increasing demand on lighter, thinner, and smaller wireless communication devices, the volume of the antenna has to be further reduced for meeting the trend of device miniaturization.

Some wireless communication devices are required to support transmitting/receiving signals at multiple frequency bands, such as 2.4 GHz and 5 GHz. To transmit/receive wireless signals at multiple frequency bands, the wireless communication device has to be provided with multiple antennas. However, it is difficult to reduce the overall volume of the wireless communication device because that the required space for arranging multiple antennas is hard to be reduced.

SUMMARY

In view of the foregoing, it is appreciated that a substantial need exists for antenna structure that is compact in size and capable of providing good radiation characteristic, supporting transmitting/receiving signals at multiple frequency bands, and having sufficient operation bandwidth.

An exemplary embodiment of a dual-band antenna is disclosed comprising: a first antenna for operating at a first frequency band and comprising: a first radiating portion comprising a plurality of separated radiating strips positioned on a first plane of a circuit board; a second radiating portion comprising a plurality of separated radiating strips positioned on a second plane of the circuit board; and a plurality of vias for coupling the plurality of radiating strips on the first plane with the plurality of radiating strips on the second plane to form a spiral radiating body; a second antenna for operating at a second frequency band and comprising a radiating plane coupled with the first radiating portion or the second radiating portion; a shorting element coupled with the radiating plane and shared by the first antenna and the second antenna; and a feeding element coupled with the radiating plane and shared by the first antenna and the second antenna; wherein the area of the radiating plane is greater than that of each of the radiating strips of the first and second radiating portions, and the width of part of the radiating plane gradually increases along a first direction.

An exemplary embodiment of a wireless communication apparatus is disclosed comprising: a circuit board comprising a first plane, a second plane, and a grounded region; a first antenna for operating at a first frequency band and comprising: a first radiating portion comprising a plurality of separated first radiating strips positioned on the first plane; a second radiating portion comprising a plurality of separated second radiating strips positioned on the second plane; and a plurality of first vias for coupling the plurality of first radiating strips with the plurality of second radiating strips to form a three-dimensional spiral for the first antenna; a second antenna for operating at a second frequency band higher than the first frequency band, the second antenna comprising a first radiating plane coupled with the first radiating portion or the second radiating portion; a first shorting element coupled with the first radiating plane and shared by the first antenna and the second antenna; and a first feeding element coupled with the first radiating plane and shared by the first antenna and the second antenna; wherein the area of the first radiating plane is greater than that of each of the radiating strips of the first and second radiating portions, and the width of part of the first radiating plane gradually increases along a first direction.

It is understood that both the foregoing general descriptions and the following detailed descriptions are exemplary and explanatory only and are not restrictive of the invention, as claimed.

DETAILED DESCRIPTION

Reference will now be made in detail to embodiments of the invention, which are illustrated in the accompanying drawings. The same reference numbers may be used throughout the drawings to refer to the same or like parts or components.

Certain terms are used throughout the description and following claims to refer to particular components. As one skilled in the art will appreciate, vendors may refer to a component by different names. This document does not intend to distinguish between components that differ in name but not in function. In the following description and in the claims, the terms "include" and "comprise" are used in an open-ended fashion, and thus should be interpreted to mean "include, but not limited to . . . " Also, the phrase "coupled with" is intended to compass any indirect or direct connection. Accordingly, if this document mentioned that a first device is coupled with a second device, it means that the first device may be directly or indirectly connected to the second device through an electrical connection, wireless communications, optical communications, or other signal connections with/without other intermediate devices or connection means.

Figure 1:
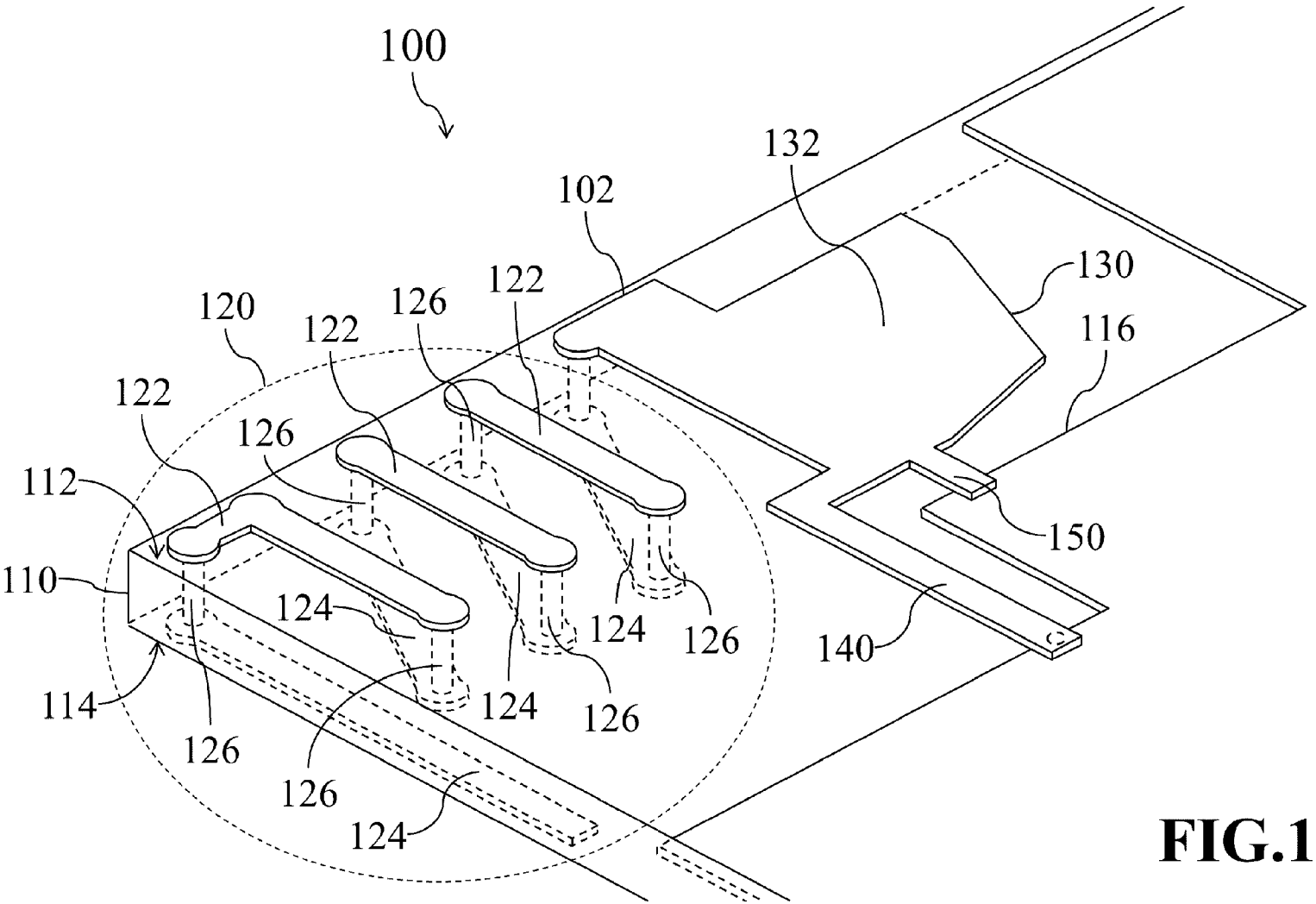
FIG. 1 is a simplified partial perspective view of a wireless communication apparatus according to a first exemplary embodiment.
Figure 2:
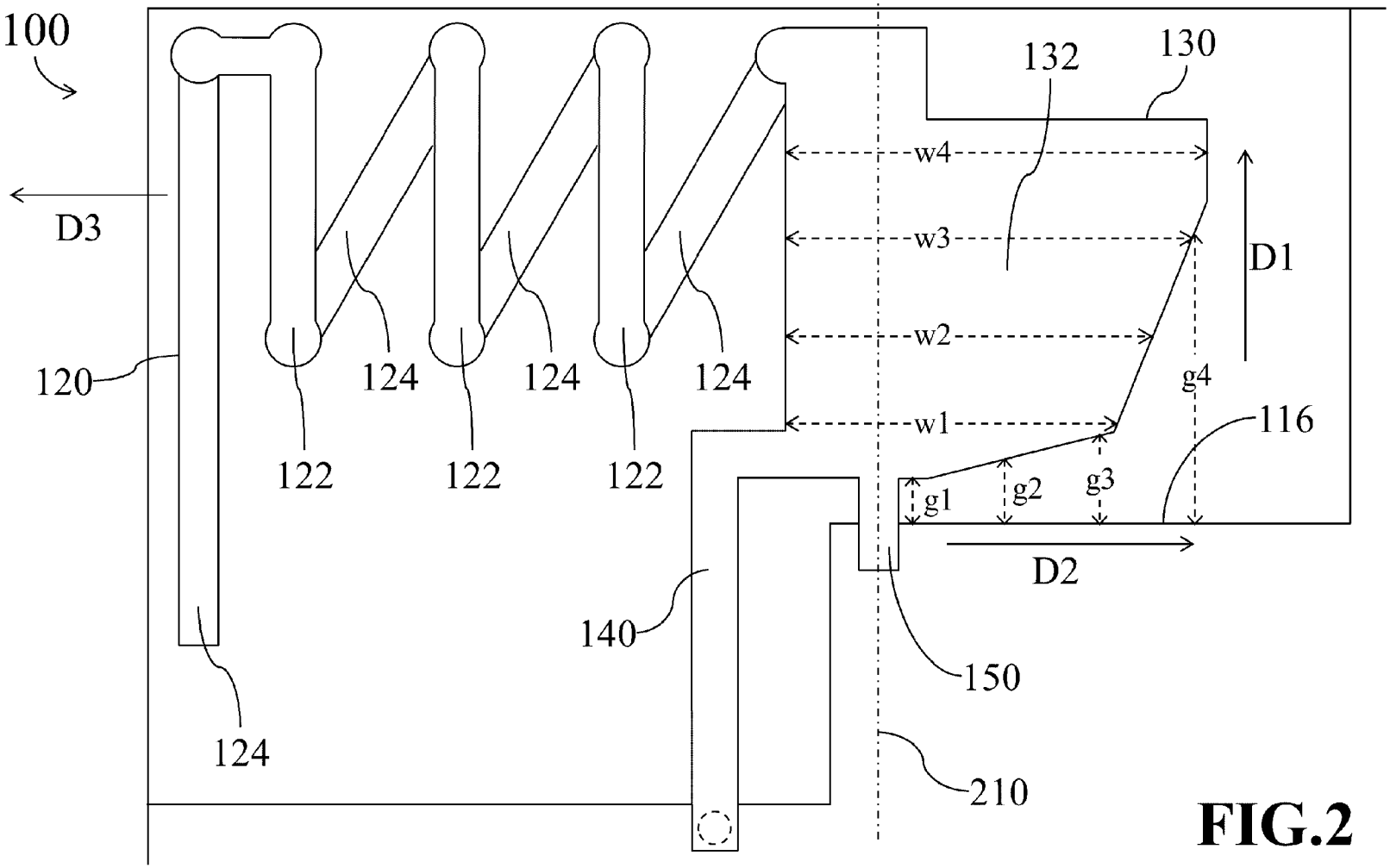
FIG. 2 is a simplified partial top view of the wireless communication apparatus of FIG. 1.

Please refer to FIG. 1 and FIG. 2. FIG. 1 shows a simplified partial perspective view of a wireless communication apparatus 100 according to a first exemplary embodiment. FIG. 2 shows a simplified partial top view of the wireless communication apparatus 100. The wireless communication apparatus 100 comprises a dual-band antenna 102 and a circuit board 110. The dual-band antenna 102 comprises an antenna 120, an antenna 130, a shorting element 140, and a feeding element 150. In this embodiment, the antenna 120 is utilized for operating at a first frequency band, such as the 2.4 GHz band, and the antenna 130 is utilized for operating at a second frequency band higher than the first frequency band, such as the 5 GHz band.

The circuit board 110 comprises a first plane 112, a second plane 114, and a grounded region 116. In implementations, the first plane 112 may be positioned on the upper surface of the circuit board 110, and the second plane 114 may be positioned on the lower surface of the circuit board 110, as illustrated in FIG. 1. But this is merely an exemplary embodiment rather than a restriction of the practical implementations. For example, in embodiments where the circuit board 110 has a multiple-layer structure, the first plane 112 may be the upper surface of the circuit board 110 or any interior surface sandwiched between the multiple-layer structure, and the second plane 114 may be the lower surface of the circuit board 110 or any other interior surface sandwiched between the multiple-layer structure. The grounded region 116 of the circuit board 110 may be directly printed on either the first plane 112 or the second plane 114. Alternatively, the grounded region 116 may be arranged in any interior surface in the multiple-layer structure of the circuit board 110. For the sake of brevity, other components of the circuit board 110 are not shown in FIG. 1 and FIG. 2.

The antenna 120 comprises a plurality of separated radiating strips 122 positioned on the first plane 112 and a plurality of separated radiating strips 124 positioned on the second plane 114. Those radiating strips 122 constitutes a first radiating portion of the antenna 120 and those radiating strips 124 constitutes a second radiating portion of the antenna 120. In implementations, the afore-mentioned radiating strips 122 may include radiating strips of different shape and length. In the embodiment of FIG. 1, for example, the first radiating portion of the antenna 120 comprises two I-shaped radiating strips 122 of the same configuration and an L-shaped radiating strip 122. Similarly, the afore-mentioned radiating strips 124 may include radiating strips of different shape and length. In the embodiment of FIG. 1, for example, the second radiating portion of the antenna 120 comprises three I-shaped radiating strips 124 of the same length and a longer I-shaped radiating strip 124.

In manufacturing, each of the radiating strips 122 may be directly printed to form on the first plane 112, and each of the radiating strips 124 may be directly printed to form on the second plane 114 so as to reduce the complexity and cost of manufacturing.

The antenna 120 further comprises a plurality of vias 126 for coupling the plurality of radiating strips 122 on the first plane 112 with the plurality of radiating strips 124 on the second plane 114 to constitute a three-dimensional spiral radiating body.

In one embodiment, the vias 126 of the antenna 120 are conductive through holes, each of which has an interior surface coated with conductive material, such as copper. The conductive vias 126 cause inductive effect during operations, so that the length of the radiating body of the antenna 120 can be reduced to less than one quarter wavelength of the radio signal received/transmitted by the antenna 120. In other words, for supporting a particular operating frequency, the use of the vias 126 is able to effectively reduce the required size or radiating body length of the antenna 120, thereby effectively reducing the required volume for the antenna 120.

The antenna 130 comprises a radiating plane 132. The radiating plane 132 may be directly printed to form on the layer, on which the first radiating portion or the second radiating portion of the antenna 120 is positioned, and directly connected to the antenna 120. Alternatively, the radiating plane 132 may be coupled with the first radiating portion or the second radiating portion of the antenna 120 via a through hole. The area of the radiating plane 132 is greater than that of each of the radiating strips of the first and second radiating portions of the antenna 120. In implementations, the radiating plane 132 may be configured to have a main body substantively in the form of a rectangle, a trapezoid, a triangle, a polygon, a half circle, a bell, an irregular, etc.

In order to provide greater operation bandwidth for the antenna 130, the radiating plane 132 is so designed that the width of part of the radiating plane 132 is gradually increased along a first direction. In addition, for obtaining better impedance matching, the dual-band antenna 102 is configured to have a gap between the radiating plane 132 and the grounded region 116 and the gap is gradually increased along a second direction. The afore-mentioned first direction and the second direction may be substantially perpendicular to each other or may have an included angle ranging from 30 to 150 degrees.

In the embodiment shown in FIG. 2, for example, the width of part of the radiating plane 132 gradually increases along a direction D1 so that the width w4 is greater than the width w3, the width w3 is greater than the width w2, and the width w2 is greater than the width w1, wherein each of w1 through w4 is ranging from 2.5 mm~5.5 mm. The gap between the radiating plane 132 and the grounded region 116 gradually increases along a direction D2 so that the gap g4 is greater than the gap g3, the gap g3 is greater than the gap g2, and the gap g2 is greater than the gap g1, wherein each of g1 through g4 is ranging from 0.5 mm~3.0 mm. In this embodiment, the direction D1 is substantially perpendicular to the direction D2.

The shorting element 140 may be directly connected to the radiating plane 132 of the antenna 130, or coupled with the radiating plane 132 of the antenna 130 through a via. The feeding element 150 may be directly connected to the radiating plane 132 of the antenna 130, or coupled with the radiating plane 132 of the antenna 130 through a via. In the wireless communication apparatus 100, the shorting element 140 and the feeding element 150 are shared by the antenna 120 and the antenna 130. In the dual-band antenna 102, if the feeding element 150 defines an axis, then more than 65% of the area of the antenna 120 would be located in one side of the axis, and more than 50% of the area of the radiating plane 132 of the antenna 130 would be located in another side of the axis. For example, in the embodiment shown in FIG. 2, an axis 210 is defined by the feeding element 150, and the antenna 120 is completely located in the left side of the axis 210 while more than 70% of the area of the radiating plane 132 of the antenna 130 is located in the right side of the axis 210.

As illustrated in FIG. 2, the radiating body of the antenna 120 is spirally extended toward a direction D3 from a place with which the antenna 120 and the antenna 130 are coupled. The direction D3 and the direction D1 may be substantially perpendicular to each other or may have an included angle ranging from 30 to 150 degrees. In this embodiment, the direction D3 is substantially perpendicular to the direction D1. In implementations, the radiating body of the antenna 120 may spirally extend to the direction D3 clockwise or counterclockwise.

In some embodiments where the antenna 120 operates at the 2.4 GHz band and the antenna 130 operates at the 5 GHz band, the dual-band antenna 102 for simultaneously supporting the operations at both the 2.4 GHz band and the band of 5.15~5.85 GHz requires only an area about 14 mm×8 mm. This offers a much greater effective bandwidth for the antenna 130 than conventional mini-sized dual-band antennas. Accordingly, the disclosed dual-band antenna 102 is very suitable for mini-sized wireless communication apparatuses, such as USB dongle wireless cards.

Figure 3:
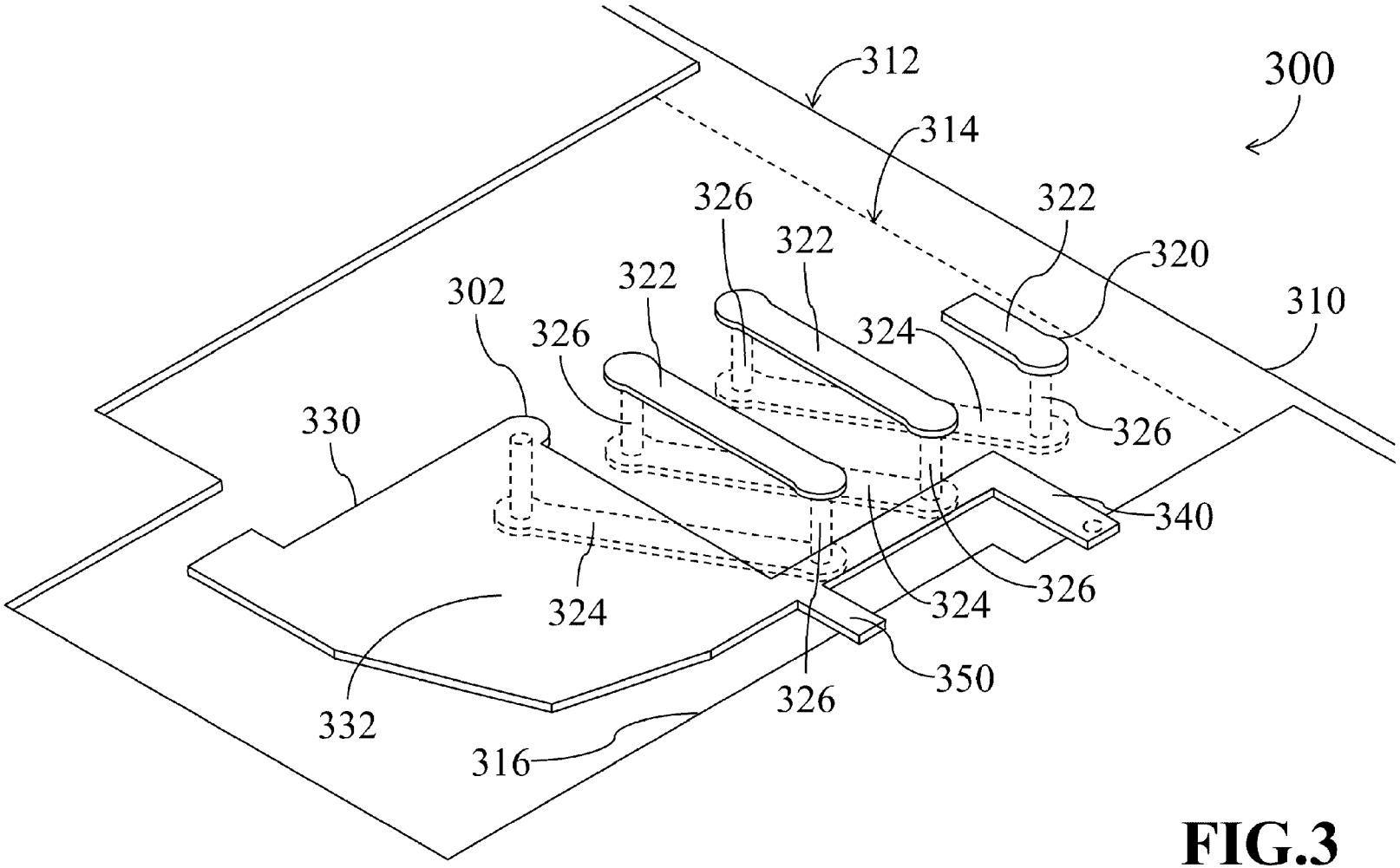
FIG. 3 is a simplified partial perspective view of a wireless communication apparatus according to a second exemplary embodiment.
Figure 4:
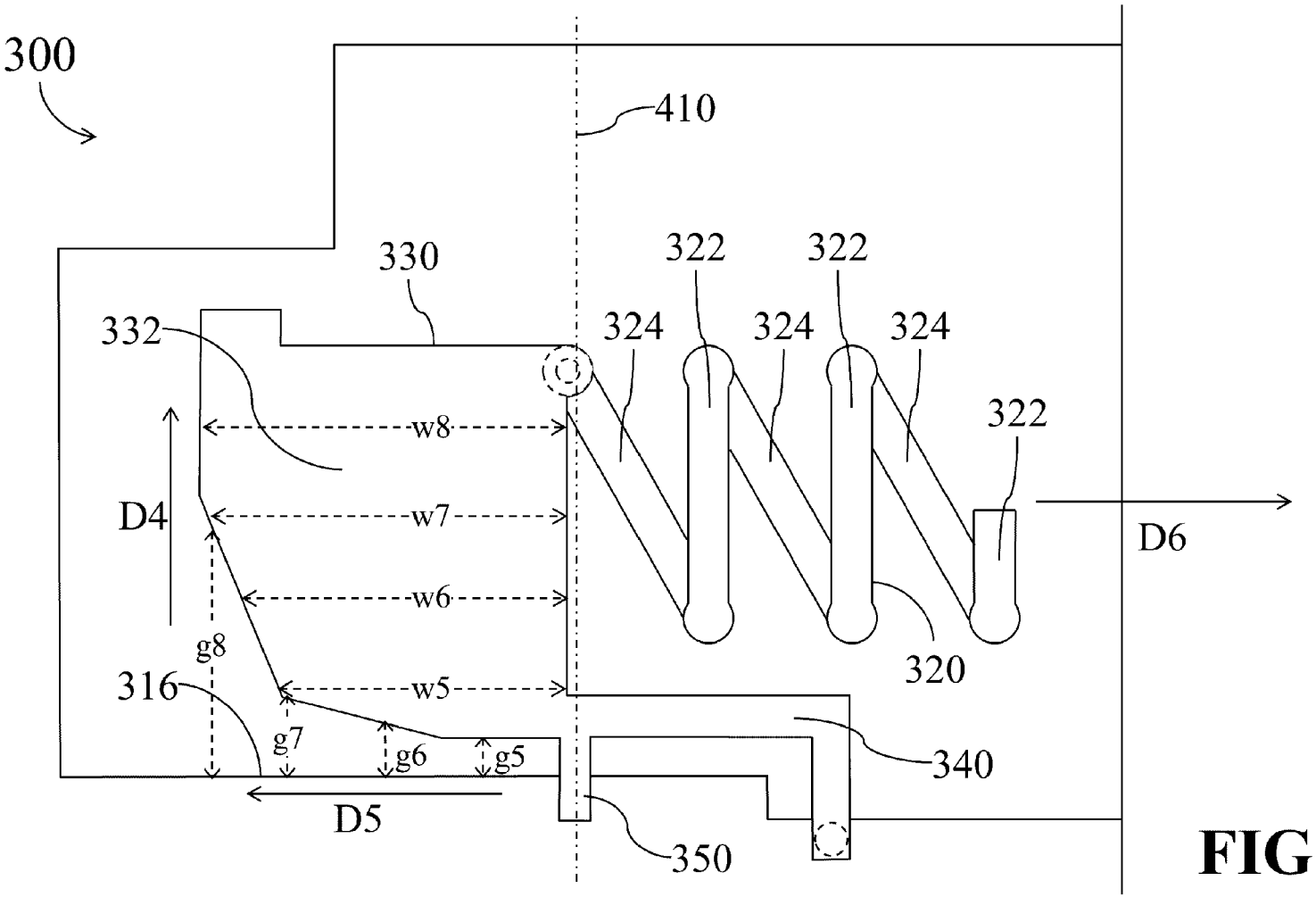
FIG. 4 is a simplified partial top view of the wireless communication apparatus of FIG. 3.

Please refer to FIG. 3 and FIG. 4. FIG. 3 shows a simplified partial perspective view of a wireless communication apparatus 300 according to a second exemplary embodiment. FIG. 4 shows a simplified partial top view of the wireless communication apparatus 300. The wireless communication apparatus 300 comprises a dual-band antenna 302 and a circuit board 310. The dual-band antenna 302 comprises an antenna 320, an antenna 330, a shorting element 340, and a feeding element 350. In this embodiment, the antenna 320 is utilized for operating at a first frequency band, such as the 2.4 GHz band, and the antenna 330 is utilized for operating at a second frequency band higher than the first frequency band, such as the 5 GHz band.

The circuit board 310 comprises a first plane 312, a second plane 314, and a grounded region 316. The structure and implementations of the circuit board 310 are similar to that of the embodiments described previously, and thus further details are omitted here for the sake of brevity.

The antenna 320 comprises a plurality of separated radiating strips 322 positioned on the first plane 312 and a plurality of separated radiating strips 324 positioned on the second plane 314. Those radiating strips 322 constitutes a first radiating portion of the antenna 320 and those radiating strips 324 constitutes a second radiating portion of the antenna 320. In implementations, the radiating strips 322 may include radiating strips of different shape and length. In the embodiment of FIG. 3, for example, the first radiating portion of the antenna 320 comprises two I-shaped radiating strips 322 of the same length and one shorter I-shaped radiating strip 322. Similarly, the afore-mentioned radiating strips 324 may include radiating strips of different shape and length. As shown, the antenna 320 is spirally extended toward a direction D6.

In manufacturing, each of the radiating strips 322 may be directly printed to form on the first plane 312, and each of the radiating strips 324 may be directly printed to form on the second plane 314 so as to reduce the complexity and cost of manufacturing.

In addition, the antenna 320 comprises a plurality of vias 326 for coupling the plurality of radiating strips 322 positioned on the first plane 312 with the plurality of radiating strips 324 positioned on the second plane 314 to constitute a three-dimensional spiral radiating body.

The vias 326 of the antenna 320 are conductive through holes, each of which has an interior surface coated with conductive material, such as copper. The conductive vias 326 cause inductive effect during operations, so that the length of the radiating body of the antenna 320 can be reduced to less than one quarter wavelength of the radio signal received/transmitted by the antenna 320, thereby effectively reducing the required volume for the antenna 320.

The antenna 330 comprises a radiating plane 332. The radiating plane 332 may be directly printed to form on the layer, on which the first radiating portion or the second radiating portion of the antenna 320 is positioned, and directly connected to the antenna 320. Alternatively, the radiating plane 332 may be coupled with the first radiating portion or the second radiating portion of the antenna 320 via a through hole. The area of the radiating plane 332 is greater than that of each of the radiating strips of the first and second radiating portions of the antenna 320. In implementations, the radiating plane 332 may be configured to have a main body substantively in the form of a rectangle, a trapezoid, a triangle, a polygon, a half circle, a bell, an irregular, etc.

In order to offer wider operation bandwidth for the antenna 330, the radiating plane 332 is so designed that the width of part of the radiating plane 332 is gradually increased along a fourth direction. In addition, for obtaining better impedance matching, the dual-band antenna 302 is configured to have a gap between the radiating plane 332 and the grounded region 316 of the circuit board 310 and the gap is gradually increased along a fifth direction. The afore-mentioned fourth direction and the fifth direction may be substantially perpendicular to each other or may have an included angle ranging from 30 to 150 degrees.

In the embodiment shown in FIG. 4, for example, the width of part of the radiating plane 332 gradually increases along a direction D4 so that the width w8 is greater than the width w7, the width w7 is greater than the width w6, and the width w6 is greater than the width w5, wherein each of w5 through w8 is ranging from 2.5 mm~5.5 mm. The gap between the radiating plane 332 and the grounded region 316 gradually increases along a direction D5 so that the gap g8 is greater than the gap g7, the gap g7 is greater than the gap g6, and the gap g6 is greater than the gap g5, wherein each of g5 through g8 is ranging from 0.5 mm~3.0 mm. In this embodiment, the direction D4 is substantially perpendicular to the direction D5.

The shorting element 340 may be directly connected to the radiating plane 332 of the antenna 330, or coupled with the radiating plane 332 of the antenna 330 through a via. The feeding element 350 may be directly connected to the radiating plane 332 of the antenna 330, or coupled with the radiating plane 332 of the antenna 330 through a via. In the wireless communication apparatus 300, the shorting element 340 and the feeding element 350 are shared by the antenna 320 and the antenna 330.

In the dual-band antenna 302, if the feeding element 350 defines an axis, then more than 65% of the area of the antenna 320 would be located in one side of the axis, and more than 50% of the area of the radiating plane 332 of the antenna 330 would be located in another side of the axis. For example, in the embodiment shown in FIG. 4, an axis 410 is defined by the feeding element 350, and the antenna 320 is located in the right side of the axis 410 while the radiating plane 332 of the antenna 330 is located in the left side of the axis 410.

As illustrated in FIG. 4, the radiating body of the antenna 320 is spirally extended toward the direction D6 from a place with which the antenna 320 and the antenna 330 are coupled. The direction D6 and the direction D4 may be substantially perpendicular to each other or may have an included angle ranging from 30 to 150 degrees. In this embodiment, the direction D6 is substantially perpendicular to the direction D4. In implementations, the radiating body of the antenna 320 may spirally extend to the direction D6 clockwise or counterclockwise.

Similar to the embodiment illustrated in FIG. 1 and FIG. 2, the dual-band antenna 302 illustrated in FIG. 3 and FIG. 4 is able to simultaneously support the operations at both the 2.4 GHz band and the band of 5.15~5.85 GHz and capable of offering a much greater effective bandwidth for the antenna 330 with occupying a very limited space (about only 14 mm×8 mm). Therefore, the disclosed dual-band antenna 302 is very suitable for mini-sized wireless communication apparatuses, such as USB dongle wireless cards.

In conventional mini-sized wireless communication apparatuses, such as USB dongle wireless cards, it is difficult for the antenna to support both dual-band operations and multiple-input-multiple-output (MIMO) functions. This is because the interior space of the mini-sized wireless communication apparatus is very limited and it is difficult to obtain sufficient isolation between two dual-band antennas. Thus, signal coupling between two dual-band antennas often occurs, thereby causing adversely affect to the signal transmission performance of the wireless communication apparatus.

Fortunately, the drawback of the conventional mini-sized wireless communication apparatuses can be overcame by employing the architecture of the disclosed dual-band antenna 102 and/or dual-band antenna 302.

Figure 5:
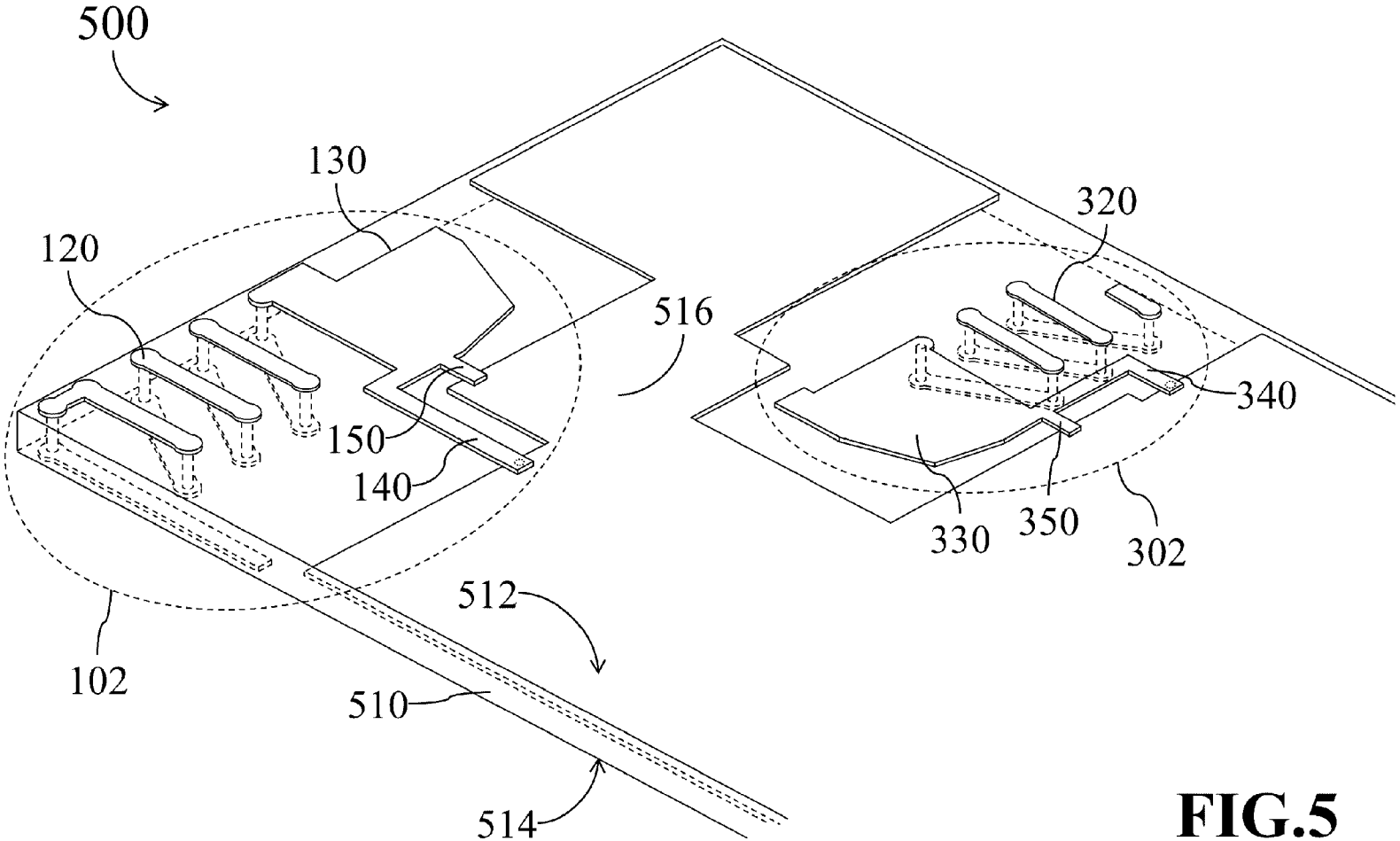
FIG. 5 is a simplified partial perspective view of a wireless communication apparatus according to a third exemplary embodiment.
Figure 6:
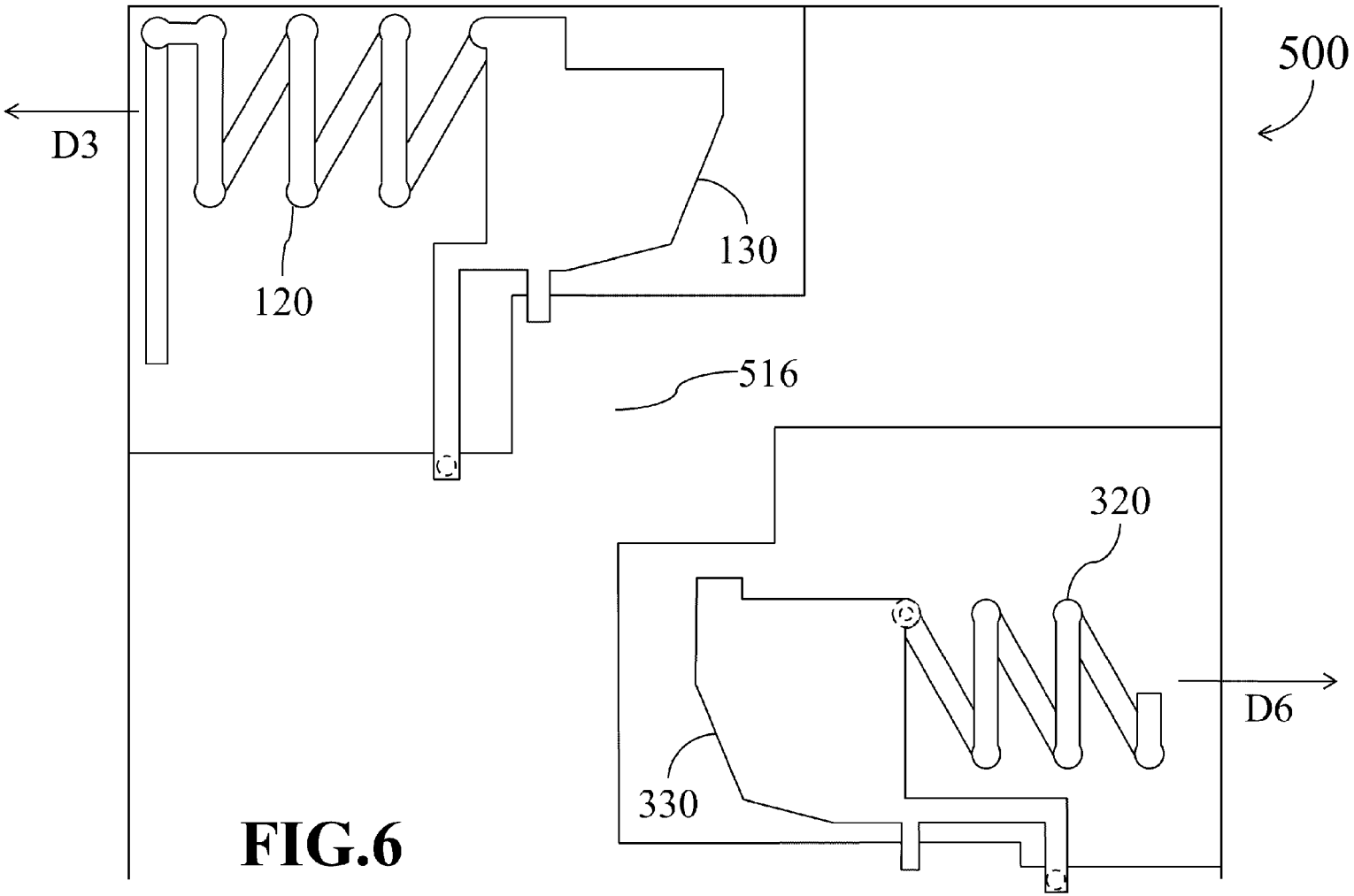
FIG. 6 is a simplified partial top view of the wireless communication apparatus of FIG. 5.

Please refer to FIG. 5 and FIG. 6. FIG. 5 shows a simplified partial perspective view of a wireless communication apparatus 500 according to a third exemplary embodiment. FIG. 6 shows a simplified partial top view of the wireless communication apparatus 500. The wireless communication apparatus 500 comprises a circuit board 510 and the afore-mentioned dual-band antenna 102 and dual-band antenna 302. In this embodiment, the antenna 120 of the dual-band antenna 102 and the antenna 320 of the dual-band antenna 302 are both utilized for operating at a first frequency band, such as the 2.4 GHz band, and the antenna 130 of the dual-band antenna 102 and the antenna 330 of the dual-band antenna 302 are both utilized for operating at a second frequency band higher than the first frequency band, such as the 5 GHz band.

The circuit board 510 comprises a first plane 512, a second plane 514, and a grounded region 516. The structure and implementations of the circuit board 510 are similar to the circuit boards 110 and 310 described previously, and thus further details are omitted here for the sake of brevity.

In the embodiment shown in FIG. 5 and FIG. 6, since the dual-band antenna 102 and the dual-band antenna 302 are both able to transmit/receive signals at both the first frequency band and the second frequency band, the wireless communication apparatus 500 is thus capable of supporting MIMO applications.

As shown, the radiating body of the antenna 120 of the dual-band antenna 102 is spirally extended toward a direction D3 from a place with which the antenna 120 and the antenna 130 are coupled, and the radiating body of the antenna 320 of the dual-band antenna 302 is spirally extended toward a direction D6 from a place with which the antenna 320 and the antenna 330 are coupled. As the included angle between the directions D3 and D6 approaches 180 degrees, the coupling effect between the antennas 102 and 302 reduces accordingly. Accordingly, the signal coupling effect between the dual-band antenna 102 and the dual-band antenna 302 can be minimized if the direction D3 is substantially perpendicular to the direction D6.

Furthermore, in the wireless communication apparatus 500, the grounded region 516 of the circuit board 510 is arranged between the antenna 130 and the antenna 330 so that the grounded region 516 can be utilized as an electrical isolator between the dual-band antenna 102 and the dual-band antenna 302 for reducing the signal coupling between the dual-band antenna 102 and the dual-band antenna 302. The signal coupling between the dual-band antenna 102 and the dual-band antenna 302 can be further reduced by configuring the grounded region 516 to have sawtooth shaped edges and dimensioning some of the edges to have a right angle as illustrated in FIG. 6.

In implementations, the first radiating portion of the antenna 120 and the first radiating portion of the antenna 320 may be positioned on the same plane or different planes of the circuit board 510. In one embodiment, for example, the first radiating portion of the antenna 120 and the first radiating portion of the antenna 320 are both positioned on the first plane 512. In another embodiment, the first radiating portion of the antenna 120 is positioned on the first plane 512 and the first radiating portion of the antenna 320 is positioned on the second plane 514.

In addition, the antenna 130 of the dual-band antenna 102 and the antenna 330 of the dual-band antenna 302 may be positioned on the same plane of the circuit board 510, such as the first plane 512. Alternatively, the antenna 130 and the antenna 330 may be respectively positioned on different planes of the circuit board 510. For example, the antenna 130 may be positioned on the first plane 512 while the antenna 330 is positioned on the second plane 514.

In the embodiment shown in FIG. 5 and FIG. 6, an antenna module capable of supporting dual-band operations and MIMO functions is realized by utilizing the cooperation of the dual-band antenna 102 and the dual-band antenna 302. Since the dual-band antennas 102 and 302 are both small in size, the combination of the dual-band antennas 102 and 302 would only occupy very limited space. In the embodiment where the antennas 120 and 320 operate at the 2.4 GHz band and the antennas 130 and 330 operate at the 5 GHz band, the combination of the dual-band antennas 102 and 302 only needs to occupy a small area about 22 mm×17 mm. Such antenna architecture not only supports operations at dual-bands (such as 2.4 GHz and 5.15~5.85 GHz), but also supports MIMO functions while significantly increasing the effective bandwidth for the antennas 130 and 330. Therefore, the disclosed antenna structure is highly applicable to the mini-sized wireless communication apparatuses, such as USB dongle wireless cards.

In implementations, the above functions and advantages may be achieved by utilizing the combination of two dual-band antennas 102 or the combination of two dual-band antennas 302.

Other embodiments of the invention will be apparent to those skilled in the art from consideration of the specification and practice of the invention disclosed herein. It is intended that the specification and embodiments be considered as exemplary only, with a true scope and spirit of the invention being indicated by the following claims.

What is claimed is:

1. A dual-band antenna, comprising:

a first antenna for operating at a first frequency band and comprising:

a first radiating portion comprising a plurality of separated radiating strips positioned on a first plane of a circuit board;

a second radiating portion comprising a plurality of separated radiating strips positioned on a second plane of the circuit board; and a plurality of vias for coupling the plurality of radiating strips on the first plane with the plurality of radiating strips on the second plane to form a spiral radiating body;

a second antenna for operating at a second frequency band and comprising a radiating plane coupled with the first radiating portion or the second radiating portion;

a shorting element coupled with the radiating plane and shared by the first antenna and the second antenna; and a feeding element coupled with the radiating plane and shared by the first antenna and the second antenna;

wherein the area of the radiating plane is greater than that of each of the radiating strips of the first and second radiating portions, and the width of part of the radiating plane gradually increases along a first direction.

2. The dual-band antenna of claim 1, wherein more than 65% of the area of the first antenna is located in one side of an axis defined by the feeding element and more than 50% of the area of the radiating plane is located in another side of the axis.

3. The dual-band antenna of claim 1, wherein the length of the radiating body of the first antenna is less than one quarter wavelength of the radio signal received/transmitted by the first antenna.

4. The dual-band antenna of claim 3, wherein more than 65% of the area of the first antenna is located in one side of an axis defined by the feeding element and more than 50% of the area of the radiating plane is located in another side of the axis.

5. The dual-band antenna of claim 3, wherein the radiating body of the first antenna is spirally extended toward a third direction from a place with which the first antenna and the second antenna are coupled.

6. The dual-band antenna of claim 5, wherein more than 65% of the area of the first antenna is located in one side of an axis defined by the feeding element and more than 50% of the area of the radiating plane is located in another side of the axis.

7. The dual-band antenna of claim 3, wherein a gap between the radiating plane and a grounded region gradually increases along a second direction.

8. The dual-band antenna of claim 7, wherein more than 65% of the area of the first antenna is located in one side of an axis defined by the feeding element and more than 50% of the area of the radiating plane is located in another side of the axis.

9. The dual-band antenna of claim 7, wherein the first direction is substantially perpendicular to the second direction.

10. The dual-band antenna of claim 9, wherein more than 65% of the area of the first antenna is located in one side of an axis defined by the feeding element and more than 50% of the area of the radiating plane is located in another side of the axis.

11. A wireless communication apparatus, comprising:

a circuit board comprising a first plane, a second plane, and a grounded region;

a first antenna for operating at a first frequency band and comprising:

a first radiating portion comprising a plurality of separated first radiating strips positioned on the first plane;

a second radiating portion comprising a plurality of separated second radiating strips positioned on the second plane; and a plurality of first vias for coupling the plurality of first radiating strips with the plurality of second radiating strips to form a three-dimensional spiral for the first antenna;

a second antenna for operating at a second frequency band higher than the first frequency band, the second antenna comprising a first radiating plane coupled with the first radiating portion or the second radiating portion;

a first shorting element coupled with the first radiating plane and shared by the first antenna and the second antenna; and a first feeding element coupled with the first radiating plane and shared by the first antenna and the second antenna;

wherein the area of the first radiating plane is greater than that of each of the radiating strips of the first and second radiating portions, and the width of part of the first radiating plane gradually increases along a first direction.

12. The wireless communication apparatus of claim 11, wherein more than 65% of the area of the first antenna is located in one side of an axis defined by the first feeding element and more than 50% of the area of the first radiating plane is located in another side of the axis.

13. The wireless communication apparatus of claim 11, further comprising:

a third antenna for operating at the first frequency band and comprising:

a third radiating portion comprising a plurality of separated third radiating strips;

a fourth radiating portion comprising a plurality of separated fourth radiating strips; and a plurality of second vias for coupling the plurality of third radiating strips with the plurality of fourth radiating strips to form a three-dimensional spiral for the third antenna;

a fourth antenna for operating at the second frequency band and comprising a second radiating plane coupled with the third radiating portion or the fourth radiating portion;

a second shorting element coupled with the second radiating plane and shared by the third antenna and the fourth antenna; and a second feeding element coupled with the second radiating plane and shared by the third antenna and the fourth antenna;

wherein the grounded region is positioned between the second antenna and the fourth antenna, the area of the second radiating plane is greater than that of each of the radiating strips of the third and fourth radiating portions, and the width of part of the second radiating plane gradually increases along a direction.

14. The wireless communication apparatus of claim 13, wherein more than 65% of the area of the first antenna is located in one side of an axis defined by the first feeding element and more than 50% of the area of the first radiating plane is located in another side of the axis.

15. The wireless communication apparatus of claim 13, wherein the length of the first radiating body of the first antenna is less than one quarter wavelength of the radio signal received/transmitted by the first antenna, and the length of the radiating body of the third antenna is less than one quarter wavelength of the radio signal received/transmitted by the third antenna.

16. The wireless communication apparatus of claim 15, wherein more than 65% of the area of the first antenna is located in one side of an axis defined by the first feeding element and more than 50% of the area of the first radiating plane is located in another side of the axis.

17. The wireless communication apparatus of claim 15, wherein the first antenna is spirally extended toward a third direction from a place with which the first antenna and the second antenna are coupled, the third antenna is spirally extended toward a sixth direction from a place with which the third antenna and the fourth antenna are coupled, and the third direction is substantially opposing to the sixth direction.

18. The wireless communication apparatus of claim 17, wherein more than 65% of the area of the first antenna is located in one side of an axis defined by the first feeding element and more than 50% of the area of the first radiating plane is located in another side of the axis.

19. The wireless communication apparatus of claim 13, wherein a gap between the first radiating plane and the grounded region gradually increases along a second direction.

20. The wireless communication apparatus of claim 19, wherein more than 65% of the area of the first antenna is located in one side of an axis defined by the first feeding element and more than 50% of the area of the first radiating plane is located in another side of the axis.

21. The wireless communication apparatus of claim 19, wherein the first direction is substantially perpendicular to the second direction.

22. The wireless communication apparatus of claim 21, wherein more than 65% of the area of the first antenna is located in one side of an axis defined by the first feeding element and more than 50% of the area of the first radiating plane is located in another side of the axis.

23. The wireless communication apparatus of claim 21, wherein the width of part of the second radiating plane gradually increases along the first direction.

24. The wireless communication apparatus of claim 23, wherein more than 65% of the area of the first antenna is located in one side of an axis defined by the first feeding element and more than 50% of the area of the first radiating plane is located in another side of the axis.

* * * * *